United States Patent [19]

Ogura et al.

[11] 4,365,930

[45] Dec. 28, 1982

[54] ELECTRIC FAN

[75] Inventors: Masato Ogura; Noriyasu Horio; Kinzo Suzuki, all of Nakatsugawa, Japan

[73] Assignee: Mitsubishi Denki Kabushiki Kaisha, Tokyo, Japan

[21] Appl. No.: 240,941

[22] Filed: Mar. 5, 1981

[30] Foreign Application Priority Data

Mar. 31, 1980 [JP] Japan ..... 55-42483[U]

[51] Int. Cl.[3] ..... F03D 3/02

[52] U.S. Cl. ..... 415/61; 98/40 V; 415/68; 416/124

[58] Field of Search ..... 415/61, 68, 115, 125; 416/120, 124; 98/40 V, 103, 108

[56] References Cited

U.S. PATENT DOCUMENTS

| | | | |
|---|---|---|---|
| 1,861,608 | 6/1932 | Persons | 415/125 |
| 2,315,667 | 4/1943 | Smith | 98/40 V |
| 2,824,429 | 2/1958 | Zucker | 98/40 V X |
| 3,173,478 | 3/1965 | Maycen | 98/40 V X |
| 3,487,805 | 1/1970 | Satterthwaite | 415/61 X |
| 4,120,615 | 10/1978 | Keem et al. | 417/360 |
| 4,217,816 | 8/1980 | Mancinelli | 415/125 X |

FOREIGN PATENT DOCUMENTS

| | | |
|---|---|---|
| 51-15641 | 4/1976 | Japan . |
| 53-11507 | 9/1978 | Japan . |
| 54-128748 | 9/1979 | Japan . |

*Primary Examiner*—William E. Tapolcai

*Attorney, Agent, or Firm*—Oblon, Fisher, Spivak, McClelland & Maier

[57] ABSTRACT

An electric fan including a casing having an air supply opening at a front part and an air suction opening at a rear part and an air passage in the casing from the air suction opening to the air supply opening; fan blades placed in the air passage or near the air suction opening as an inlet to provide air flow in the air passage from the air suction opening to the air supply opening; a first motor for rotating the fan blades; a circular air directing grille having many slits to cover the front part of the air supply opening of the casing in gyratory manner; a driving roll made of an elastic material placed on the peripheral part of air directing grille to contact the driving roll with the peripheral part of the grille with a spring force; a second motor for driving the driving roll to turn the air directing grille and the air directing grille can be rotated in stable condition under contacting of the driving roll with the peripheral surface of the air directing grille with the spring force if desired.

6 Claims, 11 Drawing Figures

ELECTRIC FAN

BACKGROUND OF THE INVENTION

1. Field of the Invention

The present invention relates to an electric fan. More particularly, it relates to a structure for turning an air directing grille of an electric fan having an air directing grille in gyratory manner for varying the direction of air flow.

2. Description of the Prior Art

The conventional electric fan comprises a base for a fan, an electric motor placed on the upper part of the base and fan blades connected to a shaft of the motor. The direction of the air flow has been selected by facing the fan blades and the motor to desired directions by utilizing the rotation of the motor. Therefore, when the space is narrow, the range of movement of the fan blades and the motor has been limited to limit the direction of the air flow. It has been disadvantageously difficult to feed the air flow to desired directions.

It has been proposed to overcome such difficulty and to provide an electric fan for feeding air flow to broad region even though the equipping space is narrow, in Australian Pat. No. 459,701. In the example of the electric fan described in the specification of the patent, the electric fan comprises a casing having an air supply opening and an air suction opening and an electric motor and fan blades kept in the casing between the air supply opening and the air suction opening. A circular air directing grille having many slits for passing the air flow fed from the fan blades in linear or curved for a desired angle is placed in gyratory manner. The air directing grille is turned by connecting gear set for transmitting driving force of the motor. Moreover, a clutch is equipped for separating the power transmission between the air directing grille and the motor. In the structure for turning the air directing grille by directly connecting the gear set to the air directing grille as the Australian patent, when the turning of the air directing grille is forcibly stopped, excess force is applied to the motor. Thus, it is necessary to equip with a complicated clutch mechanism in the preparation of the electric fan. This is disadvantageous in view of the preparation of a thin compact electric fan.

SUMMARY OF THE INVENTION

It is an object of the present invention to provide a thin compact electric fan by providing the simple structure for driving the air directing grille.

The foregoing and other objects of the present invention have been attained by providing an electric fan which comprises a casing having air supply opening at a front part and an air suction opening at a rear part and an air passage in the casing from the air suction opening to the air supply opening; fan blades for air flow in the air passage; a first motor for rotating the fan blades in the casing; an air directing grille having many slits in gyratory manner to cover the air supply opening of the casing; a second motor for turning the air directing grille and a driving roll rotated by the second motor to turn the air directing grille by contacting the driving roll with the peripheral surface of the air directing grille in the casing.

DETAILED DESCRIPTION OF THE PREFERRED EMBODIMENTS

Figure 1:
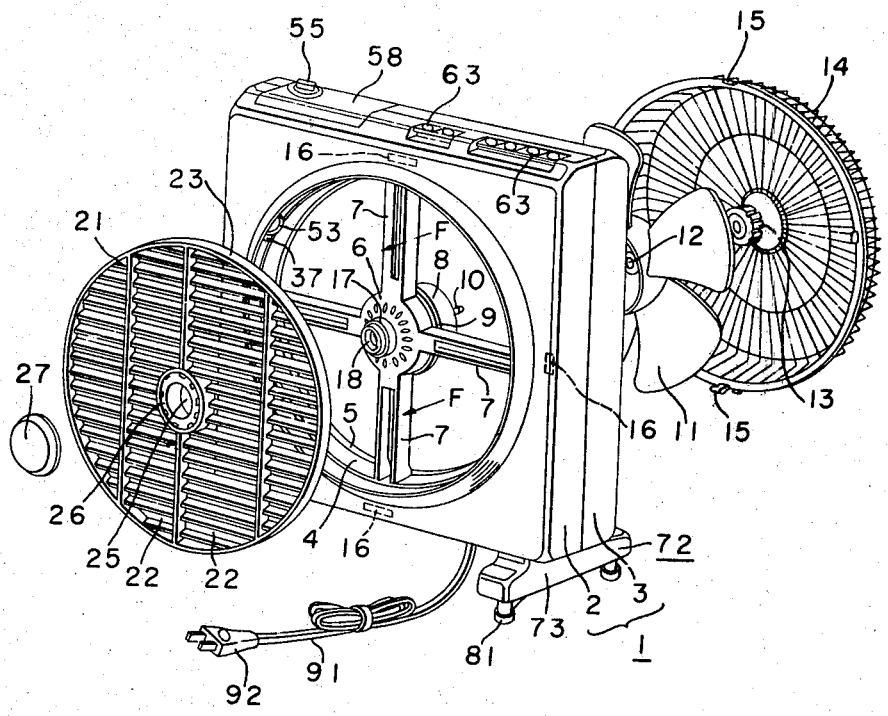
FIG. 1 is a schematic view of parts of one embodiment of an electric fan according to the present invention.

FIG. 1 is a schematic view of one embodiment of the electric fan wherein the reference (1) designates a casing comprising a front casing (2) made of a plastic material in one piece and a rear casing (3) made of a plastic material in one piece having the same outer size as the front casing.

At the same central position of the front casing (2) and the rear casing (3), the air supply opening (4) and the air suction opening (5) having the same size are form to form an air passage (R) between the air supply opening (4) and the air suction opening (5).

The reference (6) designates a supporting member formed at the position corresponding to the center of the air supply opening (4) of the front casing (2) and the supporting member is connected by legs (7) projected in one-piece to upper and lower and right and left directions to connect to the peripheral part of the air supply opening of the front casing (2). The reference (8) designates a first motor equipped through a fixture plate (9) on the rear surface of the supporting part (6) to project the end of the shaft (10) in the rear side. The reference (11) designates fan blades equipped with the shaft of the first motor to be rotated by the motor and the fan blades are made of plastic. The shaft (10) of the first motor (8) is fitted to the through-hole (12) at the center of the fan blades and a spinner nut (13) for fixing is fitting at the end of the shaft (10) so as to firmly fix the fan blades to the shaft (10) of the first motor (8).

The reference (14) designates a circular cage guard member fitted on a rear surface of a rear casing (3); so as to cover the rotary blades (11) with a desired gap.

Figure 2:
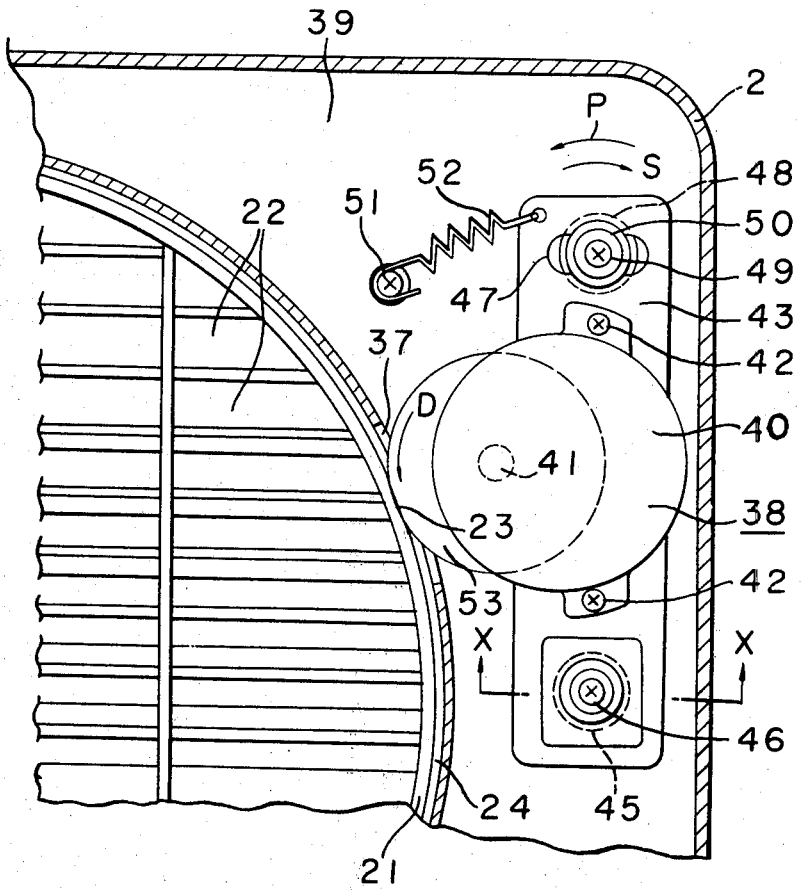
FIG. 2 is a partially enlarged vertically sectional view of the important part of the embodiment in back side.
Figure 5:
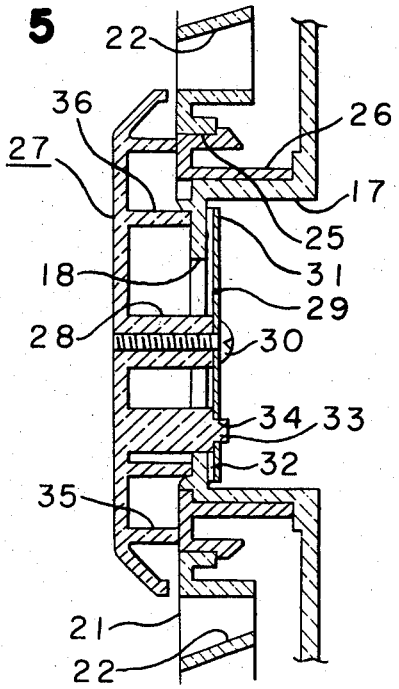
FIG. 5 is a partially enlarged vertically sectional view of the central fitting part of an air directing grille.
Figure 6:
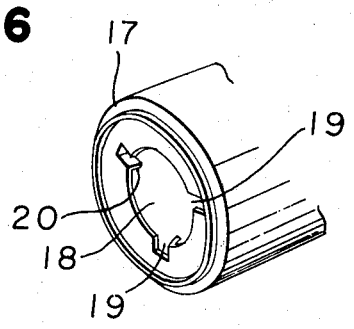
FIG. 6 is a partially enlarged schematic view of a cylinder for fitting the air directing grille in a casing.
Figure 7:
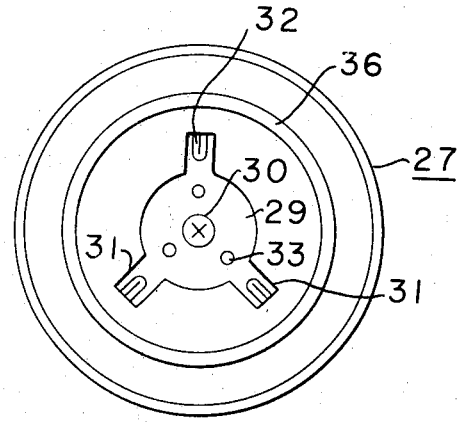
FIG. 7 is a rear view of a cap for fitting the air directing grille.
Figure 8:
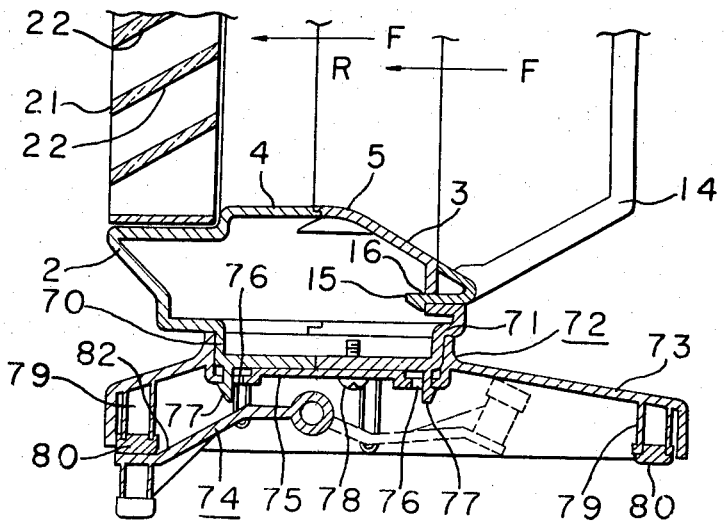
FIG. 8 is a vertically sectional view of a central bottom of the electric fan.
Figure 11:
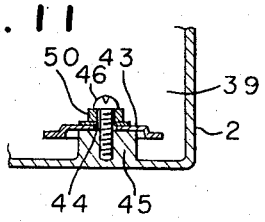
FIG. 11 is a sectional view taken along the X—X line in FIG. 2.

Four hook type clips (15) are formed in one-piece on the front surface of the guard member (14) as the fitting surface. On the other hand, through-holes (16) are respectively formed on the parts of the rear casing (3) corresponding to the clips (15) as shown in FIG. 8. The guard member (14) is fitted to the rear casing (3) by inserting the clips (15) into the through-holes (16) to be interlocked. The reference (17) designates a support cylinder formed in one-piece on the supporting part (6) at the front center of the supporting part (6) with the same axial line of the shaft (10) of the first motor (8). The shape is as shown in FIG. 6 wherein a fitting hole (18) is formed at the front center and three notches (19) extended outwardly from the peripheral part of the fitting hole are formed with each equal distance. The reference (20) designates a stopper projected from the edge of each notch (19) at the same rotary direction side. The reference (21) designates a circular air directing grille made of a plastic shown in FIG. 1. The air directing grille has two kinds of many slits (22) on the whole surface of the air directing grille. The outer diameter of the air directing grille is slightly smaller than an inner diameter of the air supply opening (4) of the front casing (2) to maintain a small gap (24) between the outer peripheral surface (23) of the air directing grille (21) and the inner peripheral surface of the air supply opening (4) of the front casing (2). A circular through-hole (25) shown in FIG. 5 is formed at the center of the air directing grille (21). A metallic bearing cylinder (26) is firmly mounted in the through-hole (25). The bearing cylinder (26) is to support the air directing grille (21) on the supporting cylinder (17) of the front casing (2) in gyratory manner and the bearing cylinder (26) is fitted to the supporting cylinder (17). The reference (27) designates a fitting cap for preventing disconnection of the air directing grille (21) from the supporting cylinder (17) of the front casing (2). The fitting cap is detachably fitted to the supporting cylinder (17) as it is clearly understood in its structure. The reference (28) designates a fitting boss projected in one-piece from the center of the rear surface of the fitting cap (27); and (29) designates a stopper plate made of a spring plate whose central part is screwed on the fitting boss and three clips (31) are formed in one-piece on the fixture plate with equal distance as shown in FIG. 7. The reference (32) designates a contacting part which is formed on the clip (31) to upwardly project; (33) designates a plurality of stopper projections in one-piece on the rear surface of the fitting cap (27) and the edge of the stopper projection is fitted to the small hole (34) of the stopper plate (29). The references (35), (36) designate annular ribs formed in each length to respectively contact with the front surface of the bearing cylinder (26) of the air directing grille (21) and the front surface of the supporting cylinder (17) of the front casing (2). The fitting cap (27) has the above-mentioned structure. The clip (31) of the stopper plate (29) of the fitting cap (27) is placed to the notch (19) of the supporting cylinder (17) and the fitting cap (27) is pushed and turned in clockwise whereby the clip (31) of the stopper place (29) is put in the supporting cylinder (17) to contact with the stopper wall (20) so as to stop the turning. In such condition, the supporting cylinder (17) is held between the contact part (32) of the clip (31) and the annular rib (36) with spring force of the stopper plate (29) from both sides. Therefore, the fitting cap (27) is not easily turned except turning the fitting cap (27) with strong force in the opposite direction to the turning direction for fitting, whereby the air directing grille (21) is held on the supporting cylinder (17) in gyratory manner without disconnection. The reference (37) designates a through-hole formed on the peripheral wall of the air supply opening (4) of the front casing (2) as shown in FIGS. 1 and 2; (38) designates a gyratory driving part of the air directing grille (21) which is held in a closed space (39) formed between the front casing (2) and the rear casing (3) near the through-hole. The structure is as follows. The reference (40) designates a second motor whose front upper end and lower end are respectively fixed on a metallic fixture plate (43) with screws (42) so as to maintain a shaft (41) in horizontal direction. The fixture plate (43) is held in the disconnectable condition by holding the through-hole (44) by a screw (46) on a cylindrical boss (45) formed in one-piece on the inner surface of the front casing (2) as shown in FIG. 11. On the other hand, the long hole (47) formed on the upper part is held in the disconnectable condition by the screw (49) on the cylindrical boss (48) of the front casing (2) whereby the fixture plate is placed to be freely moved for the length of the long hole (47) in right and left direction from the center of the through-hole (44) as shown by the arrow lines (p), (s) in FIG. 2. The reference (50) designates a cylindrical spacer placed between the fixture plate (43) and the heads of the screws (46), (49); and (51) designates a screw which is screwed in the inner surface of the front casing (2); (52) designates a tensile spring hooked between the screws and the upper edge of the fixture plate (43); and (53) designates a driving roller made of an elastic material such as rubber whose center is fixed on the shaft (41) of the second motor (40), and the roller is placed to project the outer peripheral part through the through-hole (37) whereby the roller (53) is brought into contact with the peripheral surface (23) of the air directing grille (21) with a constant pressure applied by the tensile spring (52). The structure of the driving part (38) of the air directing grille (21) is as mentioned above.

Figure 3:
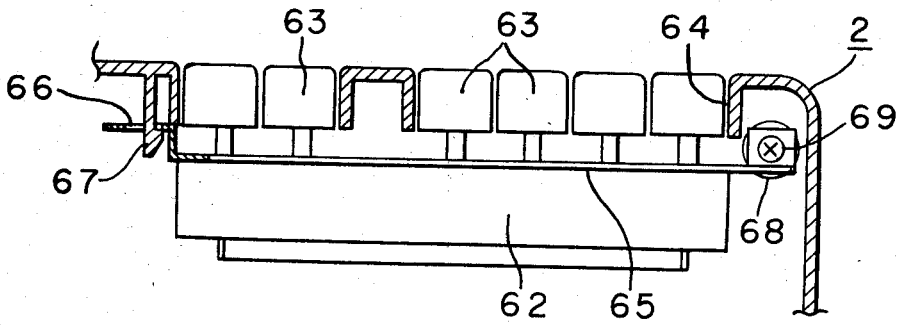
FIG. 3 is a vertically sectional view of a control switch part thereof.
Figure 4:
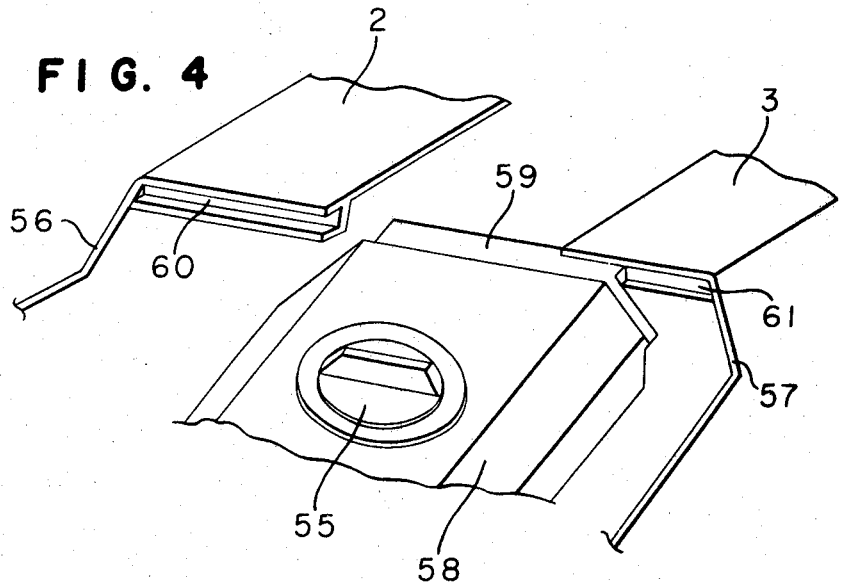
FIG. 4 is a schematic view of a part for fitting a time switch panel.
Figure 9:
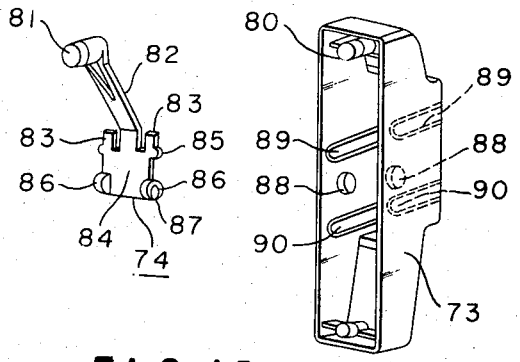
FIG. 9 is a schematic view of parts of a stand part of the electric fan.

A time switch (not shown) which sets a driving time of the first motor (8) is held in a closed space (39) formed between the front casing (2) and the rear casing (3) and only dial (55) of the time switch is exposed on the front casing (2) or the rear casing (3). The references (56), (57) respectively designate notches formed on the upper surfaces of the front casing (2) and the rear casing (3) at corresponding parts thereof; (58) designates a switch panel held by the front casing (2) and the rear casing (3) so as to close the notches; (59) designates inserting projections formed in one-piece on both ends of the switch panel; and (60), (61) respectively designate guide grooves having channel or ]-shape in which the inserting projections are fitted to prevent disconnection of the switch panel (58) by inserting the projections (59) of the switch panel (58) in the assembly of the front casing (2) and the rear casing (3) as shown in FIG. 4. The reference (62) designates a control switch for controlling electric currents of the first motor (8) and the second motor (40). The push button (63) for operating the switch is exposed through the hole (64) formed on the front surface of the front casing (2) as shown in FIGS. 1 and 3. The reference (65) designates a fixture having a through-hole (66) at one end and the control switch (62) is fixed on it; (67) designates a hook stopper formed downwardly in one-piece on the front surface of the front casing (2) and the hook stopper is fitted to the through-hole (66) of the fixture (65). The reference (68) designates a boss formed in one-piece on the inner surface of the front casing (2); and (69) designates a screw for fixing the boss (68) to the end of the fixture in opposite to the through-hole (66). The fixture (65) is fixed on the front casing (2) by the screw and the hook stopper (67). The references (70), (71) respectively designate a pair of projected parts formed on the bottoms of the front casing (2) and the rear casing (3) as shown in FIG. 8; (72) designates a stand which is detachably fitted to the right and left bottoms of the front casing (2) and the rear casing (3) for covering the projected parts and the stand comprises a base (73) made of a plastic and a plastic adjust leg (74) held inside of the base. A recess (75) having a size for fitting to the projected parts (70), (71) is formed on the upper part of the base (73) and two stopper holes (76) are formed on the bottom of the recess and each stopper clip (77) is formed in one-piece on the bottoms of the projected parts (70), (71) of the front casing (2) and the rear casing (3) so as to be fitted to the stopper holes with spring force. Each stopper clip (77) is formed on the front casing (2) and the rear casing whereby the base (73) can be fitted only by fitting the base to the projected parts (70), (71). Moreover, the recess (75) is fitted to the projected parts (70), (71) whereby the front casing (2) and the rear casing (3) can be closely fitted to closely contact the flange surfaces of the front casing (2) and the rear casing (3). The base (73) is screwed on the rear casing (3) by a screw (78). A cylinder (79) is formed inside of the base (73) and a cushion plate (80) is fitted at the lower end of the cylinder. The adjust leg (74) comprises an arm (82) having a cushion (81) as a contacting part to the floor and a main body (84) which is connected to the arm and has a pair of springs (83) as shown in FIG. 9. A pair of projections (85) are formed on the root of the spring and a pair of fulcrum parts are formed on both sides of the main body and have each round recess (87) at the center. A pair of projections (88) are formed in one-piece so as to face each other on the inner surface of the base (73) and are fitted to the recesses (87) of the fulcrum parts (86) of the adjust leg (74) to hold the adjust leg in gyratory manner. The references (89), (90) respectively designate a pair of grooves formed on the inner surface of the base (73) at places departed in equal distance from the center of a projection (88) and the projections (85) of the adjust leg (74) are selectively inserted into the grooves.

Figure 10:
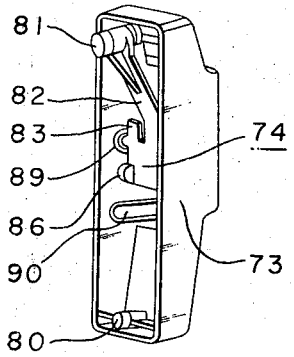
FIG. 10 is a schematic view of the assembled stand part.

When the adjust leg (74) is pushed into the base (73) from the condition shown in FIG. 9 to the condition shown in FIG. 10, the fulcrum part (86) contacts with the projection (88) of the base (73) whereby the base (73) is slightly enlarged in transversal direction by the elastic property thereof and the fulcrum part (86) rides on the projection (88) and the recess (87) is fitted to the projection (88). Moreover, when it is further pushed to fit the projections (85) of the adjust leg (74) into the grooves (89) from the condition of FIG. 9 to the condition of FIG. 10, it is deformed to reduce the width of the projections (85) by the spring (83) whereby the projections (85) are easily inserted into the grooves (89). In the adjust leg (74) held in the base (73), the arm (82) is downwardly projected from the base (73) and the upper surface is brought into contact with the cushion (80) of the cylinder (79) as shown by the full line in FIG. 8, whereby the condition for lifting the front end of the base (73) for a desired level is attained to change upwardly the air direction.

When the adjust leg (74) is turned from the condition shown by the full line in FIG. 8 in counter clockwise around the fulcrum (86), the projection (85) is once inwardly moved by the action of the spring (83) to disconnect from the groove (89). When the adjust leg (74) is further turned, the projection (85) is fitted into the other groove (90) whereby the adjust leg (74) can be completely held in the base (73) as shown by the broken line in FIG. 8. In such manner, the direction of the casing (1) can be changed from horizontal direction to the upward direction by selecting the position of the adjust leg (74) to put it in or to put it out of the base (73).

In FIG. 1, the reference (91) designates a power source cord, and (92) designates a power source plug. The front casing (2) and the rear casing (3) are fastened by screwing at plural positions with screws (not shown). The front casing (2) and the rear casing (3) can be separated by dessembling the stand (72) by unscrewing the screws and the screw (78).

The operation of the embodiment having the above-mentioned structure will be illustrated.

The power source plug (92) is pushed to connect it to the power source and the specific push button (63) is pushed to operate the control switch (62) whereby the first motor (8) is driven to rotate the fan blades (11). Air is fed from the rear side into the passage (R) of the casing (1) and is blown to the rear surface of the air directing grille in the arrow line direction F shown in FIG. 8. If the power circuit for the second motor (40) is opened by the control switch (62) by the operation of the push button (63), the air directing grille (21) is not turned and the air is fed from the fan blades (11) along many slits (22) of the air directing grille (21). Therefore, the air flow is limited to only a specific direction in a specific region. On the other hand, if the power circuit of the second motor (40) is closed by the control switch (62) actuated by pushing the specific push button (63), the second motor is driven to turn the shaft (41) at a specific speed (such as thirty-five turns per minute). The driving roll (53) is one-body of the shaft (41) is turned to the arrow line direction D shown in FIG. 2. The air directing grille (21) which is brought into contact with the driving roll (53) is smoothly turned at a specific low speed (such as several turns per minute) under supporting the central bearing cylinder (26) by the outer peripheral surface of the supporting cylinder (17) of the front casing (2). When the air directing grille (21) is turned, the air flow given by the fan blades (11) is guided to the direction of the slits (22) in the passing of air through the slits (22) of the air directing grille (21). As a result, the direction of the air flow is gradually varied depending upon the turning of the air directing grille (21) to feed the air flow in broader region.

The air directing grille (21) is driven under friction of the driving roll (53) and accordingly, even though the turning of the air directing grille (21) is forcibly stopped by certain pressure, the driving roll (53) can be turned in slipping.

In the above-mentioned embodiment, the driving roll (53) itself is made of an elastic material such as a rubber and the roll is brought into contact with the air directing grille (21) under a constant load given by the spring force of the tensile spring (52). Thus, in the normal condition of the turning of the air directing grille (21) which is not forcibly stopped, the rotation of the second motor (40) can be transmitted to the air directing grille in stable condition. Even though the roundness of the air directing grille (21) is not perfect because of size difference in the molding etc., the outer peripheral surface of the air directing grille (21) is not turned in the normal locus so as to approach it to the driving roll (53) and to depart from it. The driving roll (53) is always brought into contact with the air directing grille (21) to continue the turning at a constant speed without a trouble even in said condition.

In accordance with the electric fan of the present invention, the air directing grille (21) supported by the casing in gyratory manner is placed to cover the air supply opening (4) formed at a front of the casing (1) and the driving roll (53) contacting with the outer peripheral surface of the air directing grille is driven by the second motor (40). Therefore, the air flow fed out from the air supply opening (4) through the air passage R of the casing (1) can be continuously distributed to desired directions so as to feed the air flow to broad region at equal rate.

The driving roll (53) transmits the rotation force under contacting with the peripheral part of the air directing grille (21). Even though the turning of the air directing grille (21) is forcibly stopped or jammed, the rotation of the driving roll (53) is not stopped whereby there is no trouble of abnormal current and abnormal heating in the locking of the rotation of the second motor (40) to maintain always safety.

The air directing grille (21) itself is not forcibly turned under the abnormal condition whereby the deformation and the break of the grille can be prevented. The accident caused by inserting a finger into the part of the fan blades (11) can be prevented.

As described above, the electric fan of the present invention has the structure having a small thickness of the casing and the air flow can be fed in broad region without varying the direction of the casing. Therefore, the electric fan is effective to use in a place having only a small equipping space such as in a home.

We claim:

1. An electric fan which comprises:

a casing having an air supply opening formed at a front part of said casing and an air suction opening formed at a rear part of said casing and an air passage formed in said casing from said air suction opening to said air supply opening;

a plurality of fan blades placed in said air passage or near said air suction opening forming an inlet for providing air flow in said air passage from said air suction opening to said air supply opening during driving of said fan blades;

first motor means for driving said fan blades disposed in said casing;

an air directing grille for covering said front part of said air supply opening of said casing, said air directing grille having a peripheral edge portion and supported on said casing in a gyratory manner and including a plurality of slits formed therein for distributing said air flow through said grille;

single rotating means placed in said casing for engaging said peripheral edge portion of said air directing grille;

second motor means for rotating said rotating means in said casing for turning said air directing grille via said rotating means;

means for applying and regulating said rotating means to said peripheral edge portion of said air directing grille within a predetermined pressure range and being disposed in said casing such that said rotating means is brought into contact with said peripheral edge portion of said air directing grille under said predetermined pressure range and such that said pressure range ensures rotation of said rotating means upon jamming of said air direction grille, wherein said means for applying and regulating said rotating means further comprises;

a spring mounted to said front casing;

a fixture plate disposed on said front casing and connected to said spring;

means for pivotably connecting said fixture plate to said front casing; and means for mounting said second motor means on said fixture plate such that said means for applying and regulating said rotating means ensures continuous contact between said peripheral edge portion of said air directing grille and said rotating means irrespective of surface irregularities or deformations in said peripheral edge portion of said air directing grille.

2. The electric fan according to claim 1 wherein said rotating means further comprises an elastic surface portion for elastically contacting said peripheral edge portion of said air directing grille.

3. The electric fan according to claim 1 wherein said air directing grille further comprises a bearing disposed at the center thereof and wherein said casing further comprises a support member for supporting said bearing of said air directing grille to allow turning of said air directing grille around said support member and about said bearing part.

4. The electric fan according to claim 1 wherein said means for pivotably connecting said fixture plate to said front casing further comprises first and second connecting members respectively disposed at first and second end portions of said fixture plate and wherein said means for mounting said second motor means is disposed between said first and second connecting members.

5. The electric fan according to claim 4 wherein said means for pivotably connecting said fixture plate to said front casing further comprises said fixture plate having at least one elongated slot formed therein and wherein said first connecting member is disposed in said slot so as to limit within a predetermined range pivoting of said fixture plate about said second connecting member.

6. The electric fan according to claim 5 wherein said spring is disposed adjacent said at least one elongated slot.

* * * * *